US005518578A

United States Patent [19]

Persells et al.

[11] Patent Number: 5,518,578

[45] Date of Patent: May 21, 1996

[54] APPARATUS FOR SEALING THE FIN OF A GABLED CARTON

[75] Inventors: David L. Persells, Twin Lakes, Wis.; Shigehiro Kinoshita, Buffalo Grove, Ill.; Hisami Mitsuishi, Wheeling, Ill.; Erik Schott, Buffalo Grove, Ill.

[73] Assignee: Tetra Laval Holdings & Finance S.A., Pully, Switzerland

[21] Appl. No.: 315,400

[22] Filed: Sep. 28, 1994

[51] Int. Cl.[6] ..... B31B 1/50

[52] U.S. Cl. ..... 156/580.1; 156/583.1; 53/376.6; 53/377.7; 53/DIG. 2; 493/184; 493/206; 493/452

[58] Field of Search ..... 156/443, 475, 156/580, 580.1, 580.2, 581, 583.1; 493/184, 206, 452; 53/372.7, 375.2, 377.7, DIG. 2, 373.7, 375.9, 376.3, 376.6

[56] References Cited

U.S. PATENT DOCUMENTS

| | | | |
|---|---|---|---|
| 2,056,330 | 10/1936 | Scott | 493/452 |
| 2,085,478 | 6/1937 | Scott | 493/184 |
| 2,410,587 | 11/1946 | Monroe | 493/452 |
| 3,200,557 | 8/1965 | Schwenk | 53/477 |
| 3,789,746 | 2/1974 | Martensson et al. | 53/563 |
| 3,820,303 | 6/1974 | Martensson et al. | 53/565 |
| 4,403,465 | 9/1983 | Bachner | 156/580.2 X |
| 4,581,873 | 4/1986 | Knuppertz et al. | 156/580.2 X |
| 4,738,077 | 4/1988 | Wakbayashi et al. | 53/372.7 |
| 4,769,171 | 7/1988 | Bruveris et al. | 53/563 |
| 4,790,123 | 12/1988 | Ljungstrom et al. | 53/458 |

*Primary Examiner*—David A. Simmons
*Assistant Examiner*—J. Sells
*Attorney, Agent, or Firm*—McAndrews, Held & Malloy Ltd.; Patrick N. Burkhart

[57] ABSTRACT

An apparatus for sealing a fin at a gabled end of a carton is disclosed. The apparatus includes a longitudinal force mechanism for applying a sealing force to a first pair of opposed flaps of the gabled end of the carton. The longitudinal force mechanism is movable from a first position in which the gabled end of the carton is in a generally open condition to a second position at which the fin of the gabled end is sealed. A transverse force mechanism applies oppositely directed transverse forces to a second pair of opposed flaps of the gabled end of the carton as the longitudinal force mechanism moves from the first position to the second position. The transverse force mechanism urges the second pair of opposed flaps toward one another during movement of the longitudinal force mechanism. The second pair of opposed flaps are thus urged inward toward one another as the longitudinal force mechanism moves to form and seal the fin thereby preventing "duckbilling".

49 Claims, 7 Drawing Sheets

FIG. 4
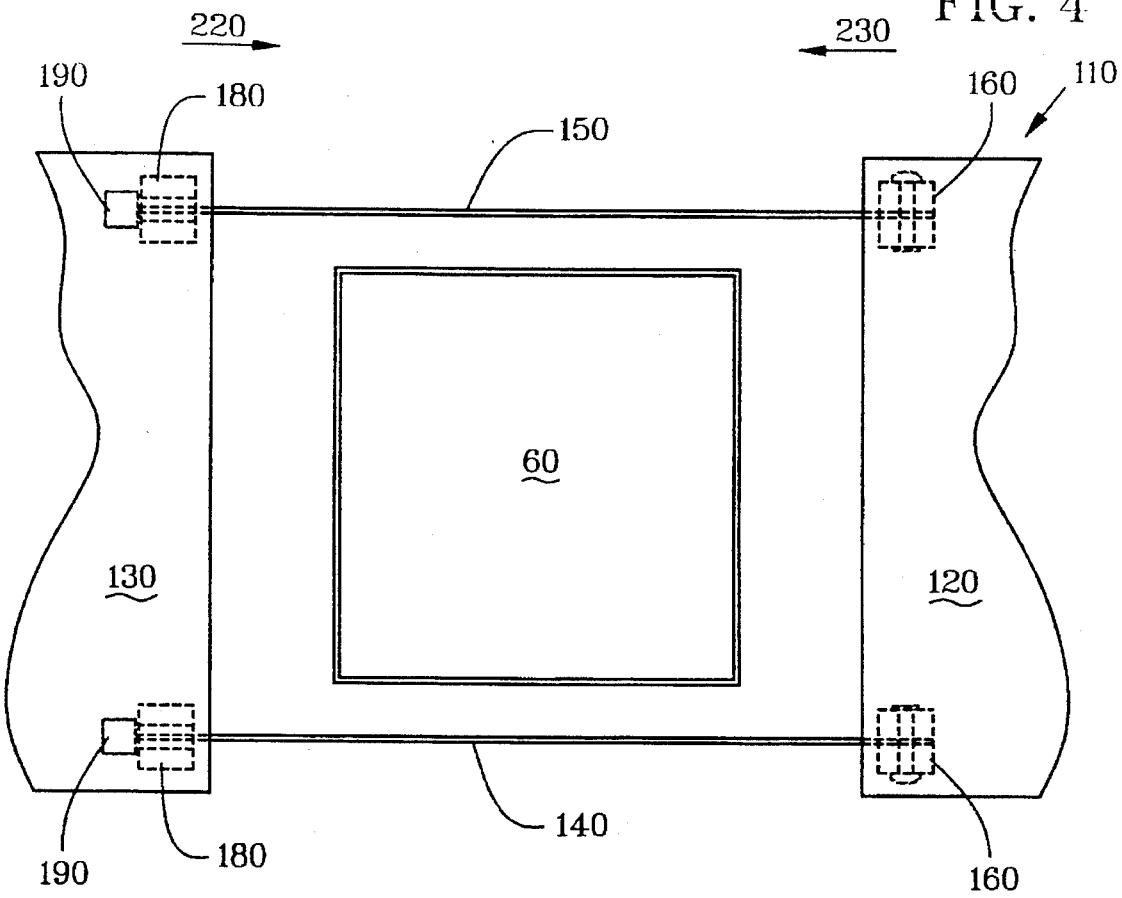
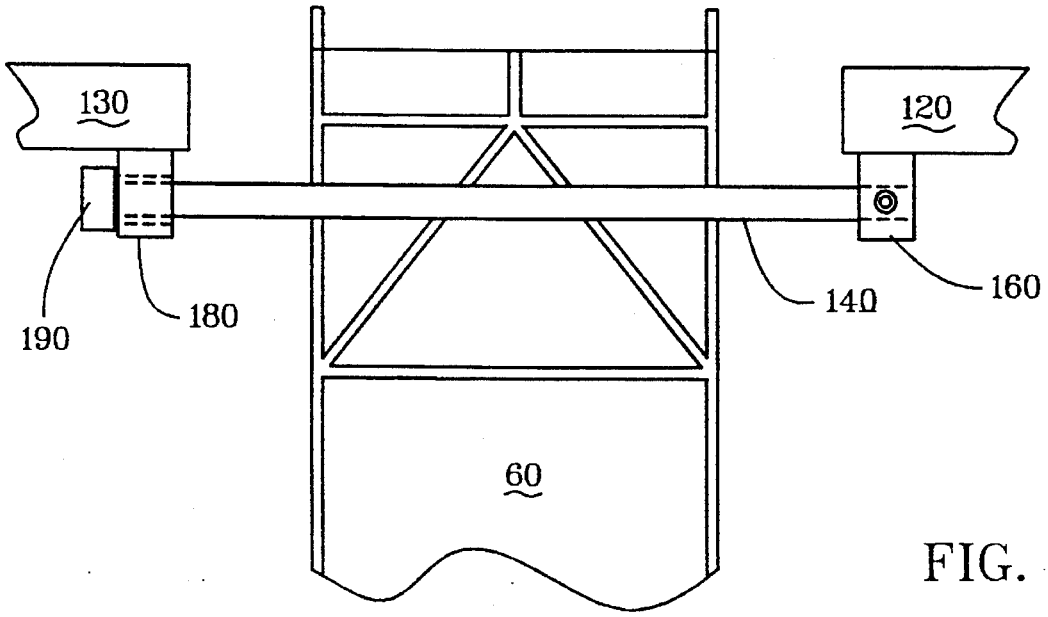
FIG. 5

APPARATUS FOR SEALING THE FIN OF A GABLED CARTON

TECHNICAL FIELD

The present invention relates to the sealing of a carton by a packaging machine. More specifically, the present invention relates to an apparatus and method for assuring proper sealing of the fin of a gabled carton at a sealing station of the packaging machine.

BACKGROUND

Gable top cartons have been known for the better part of the twentieth century. Their characteristic simplicity and resealability have helped to sustain their popularity as cartons for traditional liquid food products such as milk and juice, but in recent years they have been used for products ranging from ammunition to Epsom salts. Gable top cartons typically start out as generally rectangular carton blanks made of laminated paperboard or similar material. The carton blanks are provided with a number of creases to facilitate folding and forming the blank into a carton.

During decades of development, manufacturers of packaging machines have devised a variety of ways to form, fill and seal gable top cartons. Today, the most prevalent packaging machines for filling and sealing gable top cartons are adapted to receive the carton blank after it has been side sealed. The process of side sealing involves sealing opposite vertical edges of the carton blank together to form a polygonal (usually rectangular) sleeve. The sleeve is received on an indexable mandrel wheel which rotates the sleeve into respective positions where the end of the sleeve extending outwardly from the mandrel is folded and sealed to form the bottom of the carton.

After the carton bottom has been formed, it is removed from the mandrel and transported to a filling station where the carton is filled with product. Once the carton has been filled, the top of the carton is folded into the familiar gable top configuration and is heat sealed, thus completing the packaging process.

One example of a known packaging machine that operates generally in accordance with these principles is described in U.S. Pat. No. 3,789,746 to Martensson et al. Other examples of such packaging machines are described in U.S. Pat. No. 3,820,303 to Martensson et al., U.S. Pat. No. 4,759,171 to Bruveris et al., and U.S. Pat. No. 4,790,123 to Ljungström et al. These patents are hereby incorporated by reference.

Various mechanisms are known for sealing the fin at the gabled end of the gable top carton. One such mechanism is disclosed in U.S. Pat. No. 3,200,557 to Schwenk. In accordance with the teachings of that patent, the upper flap panels that form the gabled structure, including the fin, are first heated to allow the polyethylene coating on the cartons to soften. The carton is then transported to a position between two sealing jaws. The sealing jaws move toward one another and apply pressure to form and seal the fin.

As the sealing jaws move toward one another, it is possible for the opposed flaps that are perpendicular to the jaws to extend outward as opposed to inward toward the carton. This condition is known as "duckbilling" and renders the carton and its contents unusable.

Various mechanisms have been devised to reduce or eliminate such "duckbilling". One such mechanism is disclosed in U.S. Pat. No. 4,738,077 to Wakbayashi et al. The mechanism described in the '077 patent utilizes an inverted, V-shaped claw to pre-fold the opposed flaps at the gabled end of the carton. This pre-folding takes place at a processing station of the packaging machine that is disposed prior to the sealing station at which the fin is sealed.

Although such pre-folding of the opposed flaps may assist in reducing "duckbilling", the foregoing mechanism is not necessarily the most desirable solution to the problem. The prefolding occurs at a separate pre-folding station thus adding significant cost and bulk to the packaging machine. A more cost effective and efficient solution would be beneficial.

SUMMARY OF THE INVENTION

An apparatus for sealing a fin at a gabled end of a canon is disclosed. The apparatus includes a longitudinal force mechanism for applying a sealing force to a first pair of opposed flaps of the gabled end of the canon. The longitudinal force mechanism is movable from a first position in which the gabled end of the carton is in a generally open condition to a second position at which the fin of the gabled end is sealed. A transverse force mechanism applies oppositely directed transverse forces to a second pair of opposed panels of the gabled end of the carton as the longitudinal force mechanism moves from the first position to the second position. The transverse force urges the second pair of opposed panels toward one another during movement of the longitudinal force mechanism. The second pair of opposed panels are thus urged inward toward one another as the longitudinal force mechanism moves to form and seal the fin thereby preventing "duckbilling".

In accordance with one embodiment of the apparatus, the longitudinal force mechanism includes first and second opposed sealing jaws that are movable toward one another to the second position and away from one another to the first position. The sealing jaws may seal the fin by application of ultrasonic energy and pressure, thermal energy and pressure, or solely through pressure after heating of the panels forming the fin.

The transverse force mechanism may be constructed in several different manners. For example, the transverse force mechanism may include first and second formed springs extending between the first and second opposed sealing jaws. Each of the first and second formed springs has a tensioned state in which the formed spring is generally linear in shape and a relaxed state in which the formed spring includes a curve. The curves of the first and second formed springs extend toward one another. The formed springs are in the tensioned state when the first and second jaws are in the first position and go to the relaxed state as the first and second jaws move toward one another from the first position to the second position. When going to the relaxed state, each of the curves of the first and second formed springs engages a respective one of the second pair of opposed flaps.

In accordance with a further embodiment of the transverse force mechanism, the transverse force mechanism includes first and second rods extending between the first and second opposed jaws. A first spring member extends from one of the first and second opposed jaws opposite the first rod. The first spring member includes a guide surface that engages the first rod as the first and second opposed sealing jaws move from the first position to the second position. This engagement between the first rod and the guide surface of the first spring member causes a deflection of the first spring member which urges the first spring member toward one of the flaps of the second pair of opposed flaps. Similarly, a second spring member extends from one of the first and second opposed jaws opposite the second rod. Engagement between the second rod and the second spring member causes a deflection of the second spring member which urges the second spring member toward the other flap of the second pair of opposed flaps. The first and second spring members thus apply oppositely directed transverse forces that urge the second pair of opposed flaps toward one another to assure proper sealing of the fin.

In a still further embodiment of the transverse force mechanism, the rods may be disposed between the opposed pair of sealing jaws in a vertical fashion. In such instance, one rod may be disposed proximate one flap of the second pair of opposed flaps while the other rod may be disposed proximate the other flap of the opposed flaps.

Other objects and advantages of the present invention will become apparent upon reference to the accompanying detailed description when taken in conjunction with the following drawings.

BRIEF DESCRIPTION OF THE DRAWINGS

FIG. 4 is a top view of the apparatus of FIG. 3.

FIG. 5 is a side view of the apparatus of FIG. 3.

DETAILED DESCRIPTION OF THE PREFERRED EMBODIMENT

Figure 1:
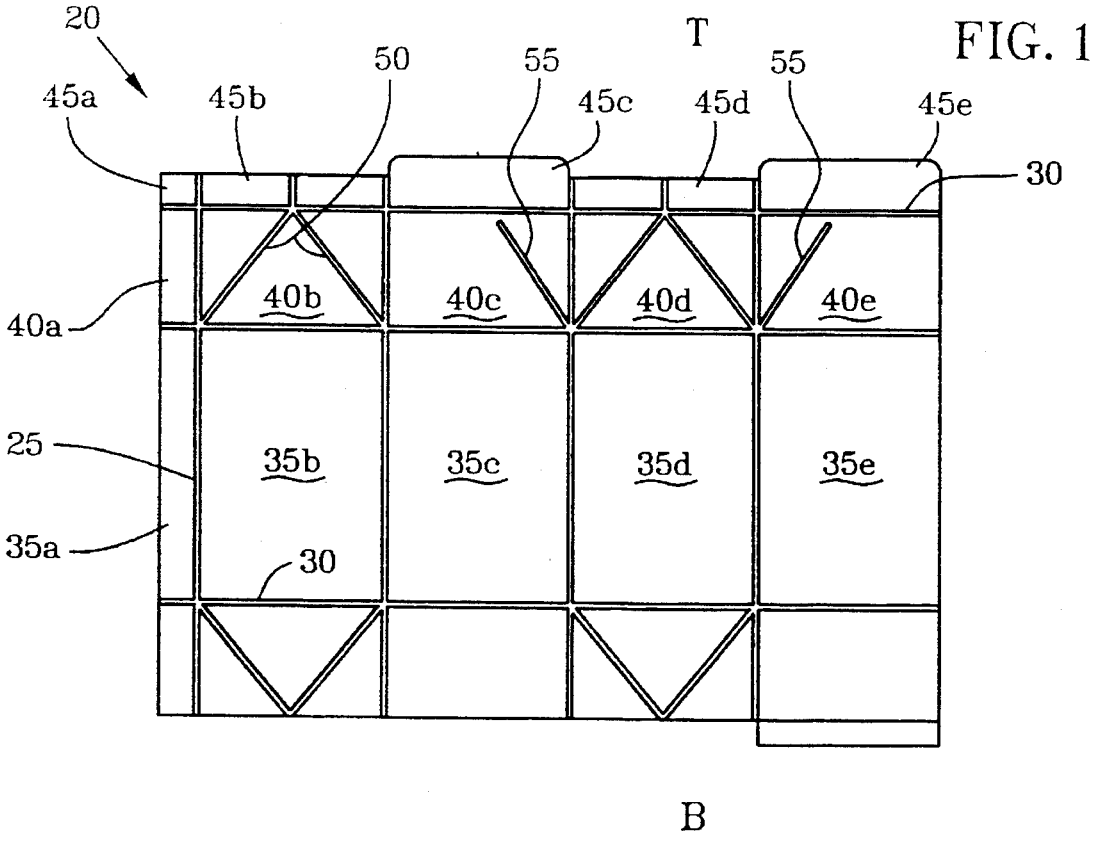
FIG. 1 is a plan view of a carton blank which may be folded to form a gable top carton.
Figure 3:
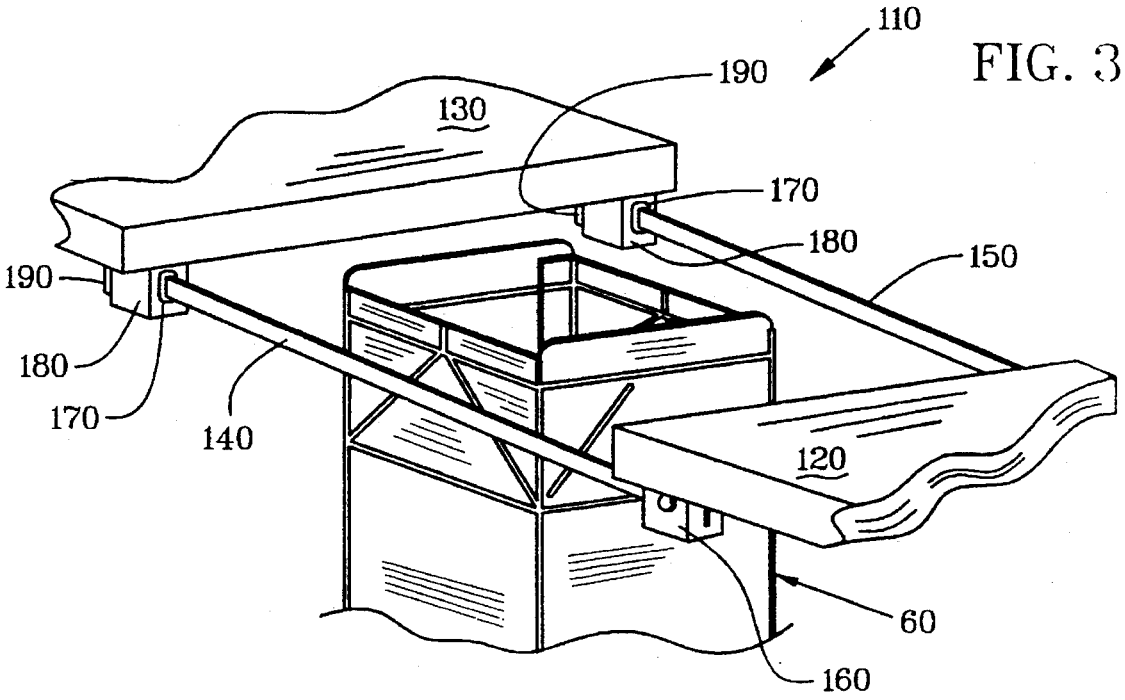
FIG. 3 is a perspective view of one embodiment of the present apparatus employing spring members to fold opposed flaps of the carton toward one another as sealing jaws move to form and seal the fin.

FIG. 1 illustrates a carton blank 20 for forming a gable top carton. The blank 20 may be formed from any one of a variety of paperboard laminate structures. For example, the blank may be formed from a laminate, such as that used for milk cartons, having an LDPE/PAPERBOARD/LDPE structure. In such a laminate, the LDPE layers act as barrier layers that, among other things, protect the paperboard from moisture. Other paperboard laminate structures may also be used in which the paperboard is protected by one or more barrier layers.

The blank 20 is divided by a plurality of vertical creases 25 and a plurality of horizontal creases 30. The vertical creases 25 extend from the top T to the bottom B of the carton blank while the horizontal creases 30 extend substantially along the width of the carton blank. The horizontal and vertical creases 25, 30 divide the carton blank into five vertical panels 35*a–e*, five top gable flaps 40*a–e*, and five top fin flaps 45*a–e*. Top gable flaps 40*b* and 40*d* are each provided with a pair of converging creases 50. Top gable flaps 40*c* and 40*e* are each provided with an angled crease 55.

Figure 2:
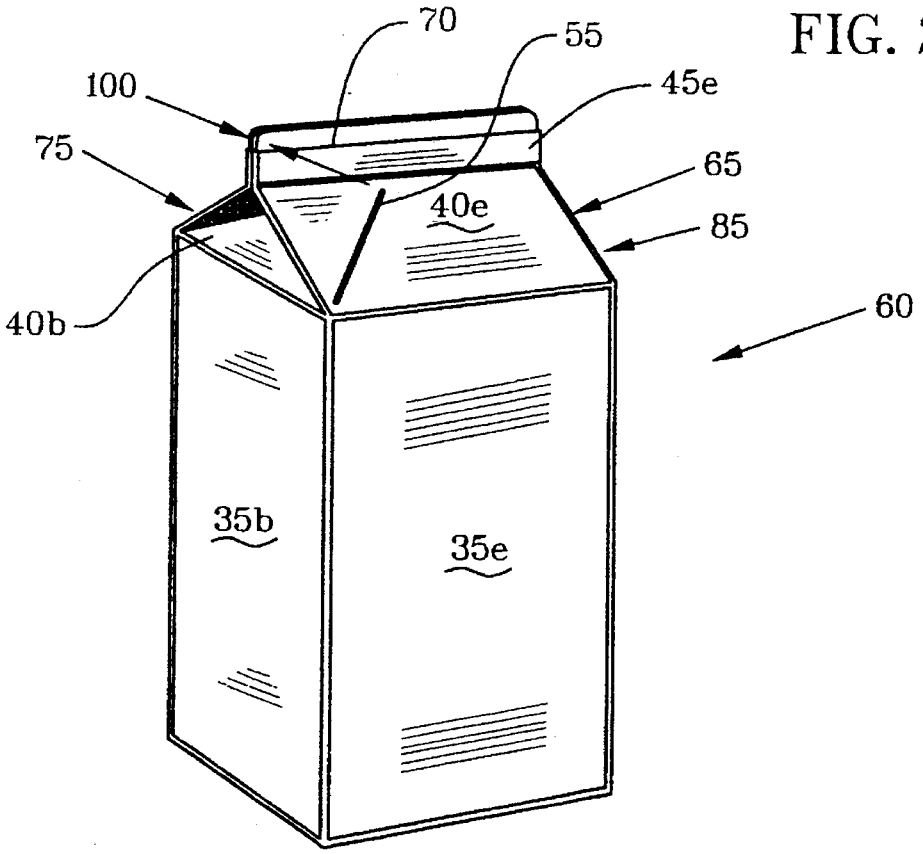
FIG. 2 is a perspective view of a carton formed from the blank illustrated in FIG. 1.

The blank 20 of FIG. 1 is folded to form the gable top carton 60 of FIG. 2. When folded, the vertical panels 35*b–c* form respective sides of the carton 60. The top gable flaps 40*b–c* form a gable structure 65 while the top fin flaps 45*b–c* form the top fin 70. The gable structure 65 is formed by folding top gable flaps 40*a* and 40*d* toward one another. Top gable flaps 40*c* and 40*e* are likewise folded toward one another and overlie top flaps 40*a* and 40*d* to form the gable structure 65. The top fin 70 extends upward from the gable structure 65. The angled creases 55 are disposed at an opening end 75 of the carton 60 and allow the gable flaps 40*c–e* and fin flaps 45*c–e* of the carton 60 to be unfolded for opening the carton. The flaps of the opening end 75 may be returned to their generally closed condition when the user wishes to at least partially seal the carton. The opening end 75 is opposite a closed end 85.

When forming and sealing the top fin 70 a sealing force is applied longitudinally along the length of the flaps 45*c* and 45*e* in the directions designated by arrow 100. The sealing force may also be applied to flaps 40*c* and 40*e* during the formation of the fin 70. As the sealing force is applied, flaps 40*b* and 45*b* fold toward flaps 40*d* and 45*d* to form the gabled structure and fin. In some instances, the flaps 40*b*, 45*b*, 40*d*, and 45*d* do not fold properly toward one another, instead extending outwardly from the interior of the carton 60. This condition is known as "duckbilling".

FIGS. 3–8 illustrate one embodiment of an apparatus that assists in preventing the occurrence of "duckbilling". The apparatus, shown generally at 110, includes a pair of opposed sealing jaws 120 and 130. The sealing jaws 120 and 130 are movable from a first position, illustrated in FIG. 4, in which the gabled end of the carton 60 is in a generally opened condition, to a second position, illustrated in FIG. 7, in which the sealing jaws 120 and 130 close and seal the fin 70. The sealer can be constructed in accordance with the teachings of U.S. Ser. No. 08/315,412 (Attorney Docket No. 10454US01; Corporate Docket No. TRX-0082), entitled "Ultrasonic Carton Sealer," filed on even date herewith.

The sealing jaws 120 and 130 may use any number of sealing technologies to accomplish sealing of the fin 70. For example, the sealing jaw 120 may be and ultrasonic horn while the sealing jaw 130 may be an anvil. Alternatively, the sealing jaws 120 and 130 may be heated, for example, by an electric heating element which heats the polyethylene layer as the sealing jaws 120 and 130 apply pressure to the fin 70. Finally, the polyethylene disposed on the panels forming the fin 70 may be heated prior to the introduction of the carton 60 at the sealing apparatus 110, in which case the sealing jaws 120 and 130 merely apply pressure to the panels to form the fin 70.

A pair of oppositely biased formed spring members 140 and 150 extend between the sealing jaws 120 and 130. Each of the spring members 140 and 150, as shown in FIGS. 4 and 5, has a first end in fixed engagement with a respective connection block 160 that is connected to the sealing jaw 120 and a second end that extends through the aperture 170 of a respective bushing 180 that is connected to the sealing jaw 130. A stop member 190 is disposed at the second end of each of the spring members 140 and 150. In the illustrated embodiment, the bushings 180 and connection blocks 160 are disposed below the respective sealing jaw 120 and 130.

Other connection schemes may be suitable for use in the disclosed apparatus, the illustrated connection schemes being exemplary of such connections. For example, the bushings 180 may be disposed on opposite sealing jaws in which case, for example, the bushing 180 associated with the spring member 140 is attached to sealing jaw 120 while the bushing 180 associated with the spring member 120 is attached to sealing jaw 130.

Figure 8:
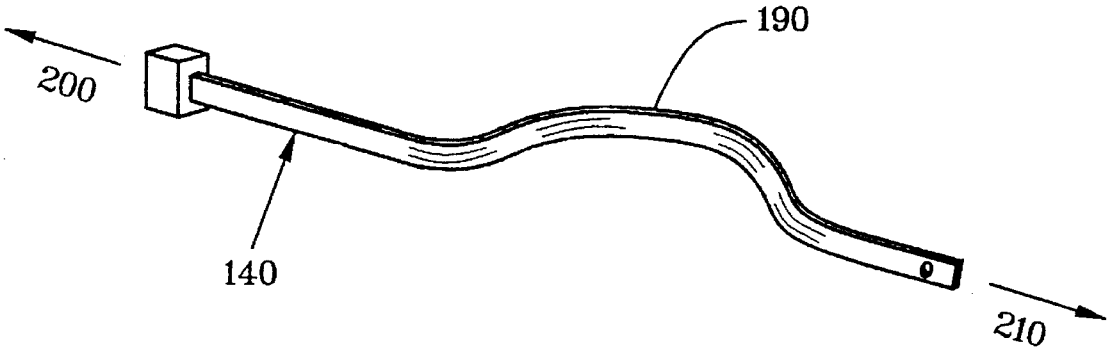
FIG. 8 is a perspective view of one of the biased spring members of the apparatus of FIG. 3.

FIG. 8 illustrates one of the spring members 140 in a relaxed state without the application of extraneous forces. As shown, the spring member 140 is biased to include a curved section 190 which may, for example, be disposed at a central potion of the spring member 140. Forces in the direction of arrows 200 and 210 may deform the spring member 140 to a tensioned state in which the spring member 140 has a generally linear shape. The spring members 140 and 150 may be constructed from formed spring steel.

Figure 6:
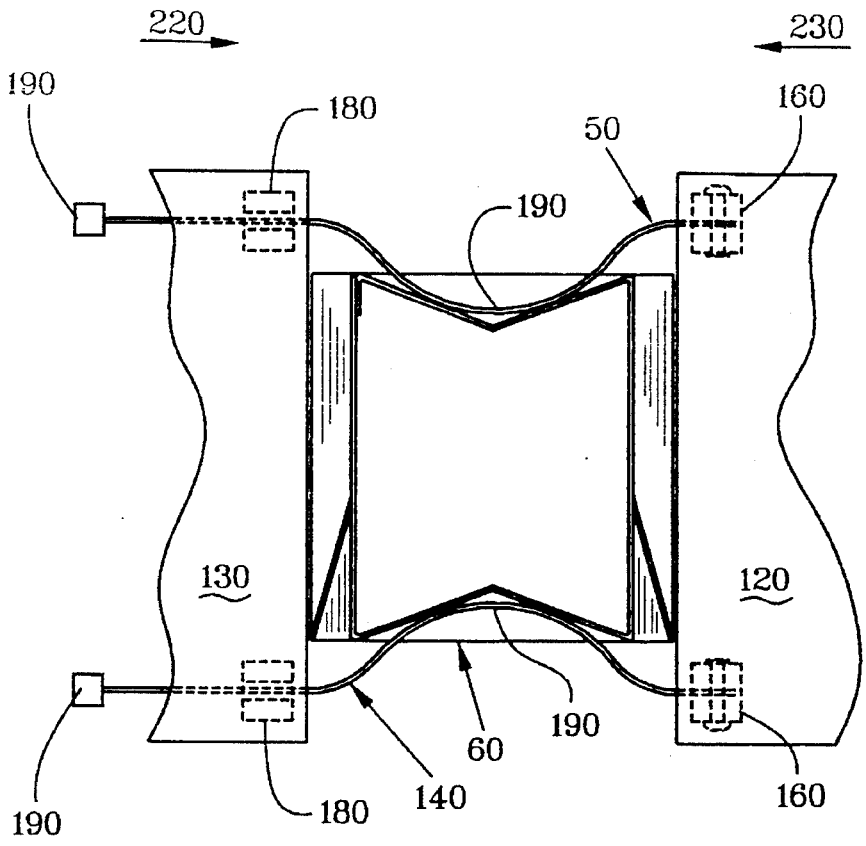
FIG. 6 is a top view of the apparatus of FIG. 3 illustrating movement of the sealing jaws to form and seal the fin.
Figure 7:
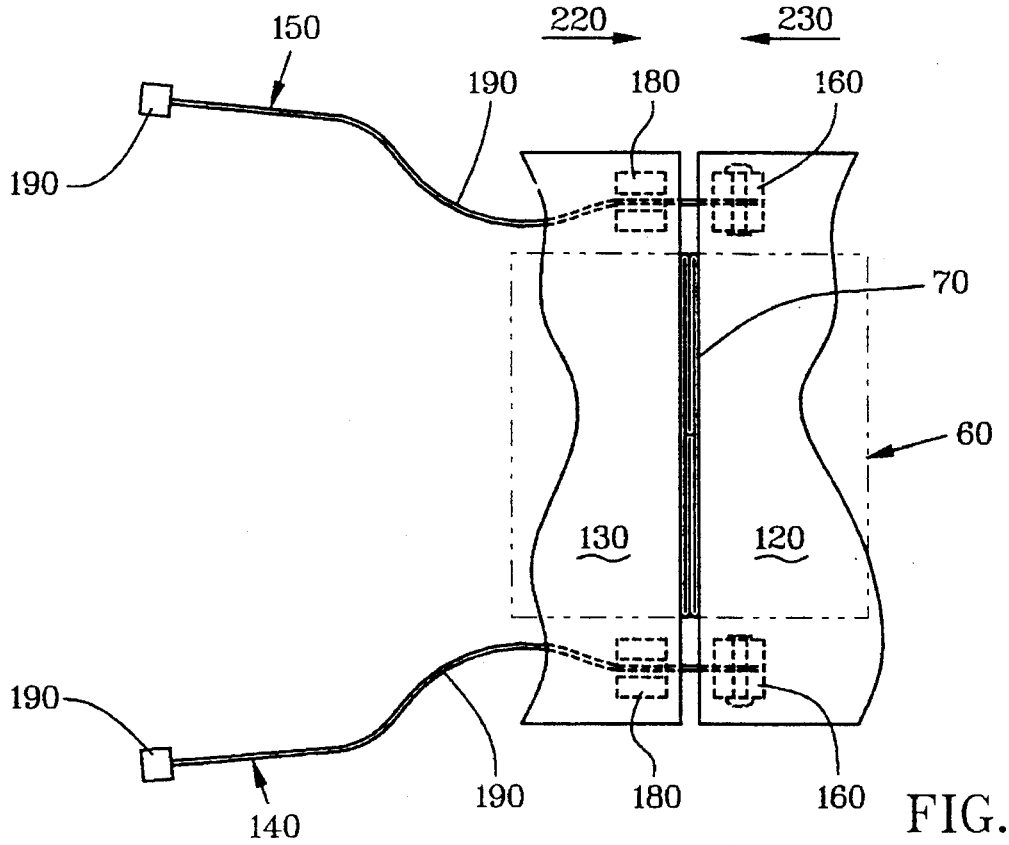
FIG. 7 is a top view of the apparatus of FIG. 3 illustrating the sealing jaws in a closed position about the fin.

FIGS. 4, 6, and 7 illustrate the operation of the apparatus 110. In operation, the sealing jaws 120 and 130 are moved to a first position, illustrated here in FIG. 4. In this first position, the sealing jaws 120 and 130 are disposed on opposite sides of the carton 60 which, for example, has been lifted between the sealing jaws by a lifter mechanism (not illustrated). The gabled section of the carton 60 is in a generally opened state and the spring members 140 and 150 are in the tensioned state. Stop members 190 prevent the spring members 140 and 150 from being pulled through the apertures of the bushings 180.

The sealing jaws 120 and 130 are then moved toward one another in the directions of arrows 220 and 230 to engage respective opposed flaps of the carton 60. As the sealing jaws 120 and 130 are moved, the spring members 140 and 150 go to the relaxed state. The curved portions 190 of the spring members 140 and 150 engage respective opposed panels of the carton, applying oppositely directed transverse forces in the directions illustrated by arrows 240 and 250 to cause panels 40*b*, 45*b*, 40*d*, and 45*d* to fold in the proper relationship.

The sealing jaws 120 and 130 ultimately move to the second position, illustrated in FIG. 7, in which the jaws engage the fin 70 to seal it. As the sealing jaws 120 and 130 move close to the second position, the spring members 140 and 150 are allowed to slide through the apertures of the bushings 180 so that they are cleared of the sealing area between the sealing jaws 120 and 130. After sealing, the sealing jaws 120 and 130 may be moved back to the first position and the carton lowered back, for example, to a carton conveyor.

Another embodiment of a sealing apparatus is illustrated in FIGS. 9–12 and is shown generally at 260 in connection with a plurality of cartons 60. In this embodiment, a pair of rods 270 and 280 extend from the underside of sealing jaw 120 and are in fixed engagement with respect to the sealing jaws 120 and 130. Each rod 270 and 280 includes a rounded end 290 which, for example, may be cylindrical, that forms a guide surface. The centers of the rounded ends 290 of the illustrated embodiment are disposed at the mid-section of the width of the respective flap. Other guide surface shapes and positions may also be utilized.

A pair of spring members 300 and 3 10 extend from the underside of and are in fixed engagement with sealing jaw 130. Each spring member 300 and 310 includes a shaped end portion 320 that forms a guide surface. As was the case with the rods 270 and 280, other shapes for the guide surfaces of the spring members 300 and 310 may be utilized.

Figure 9:
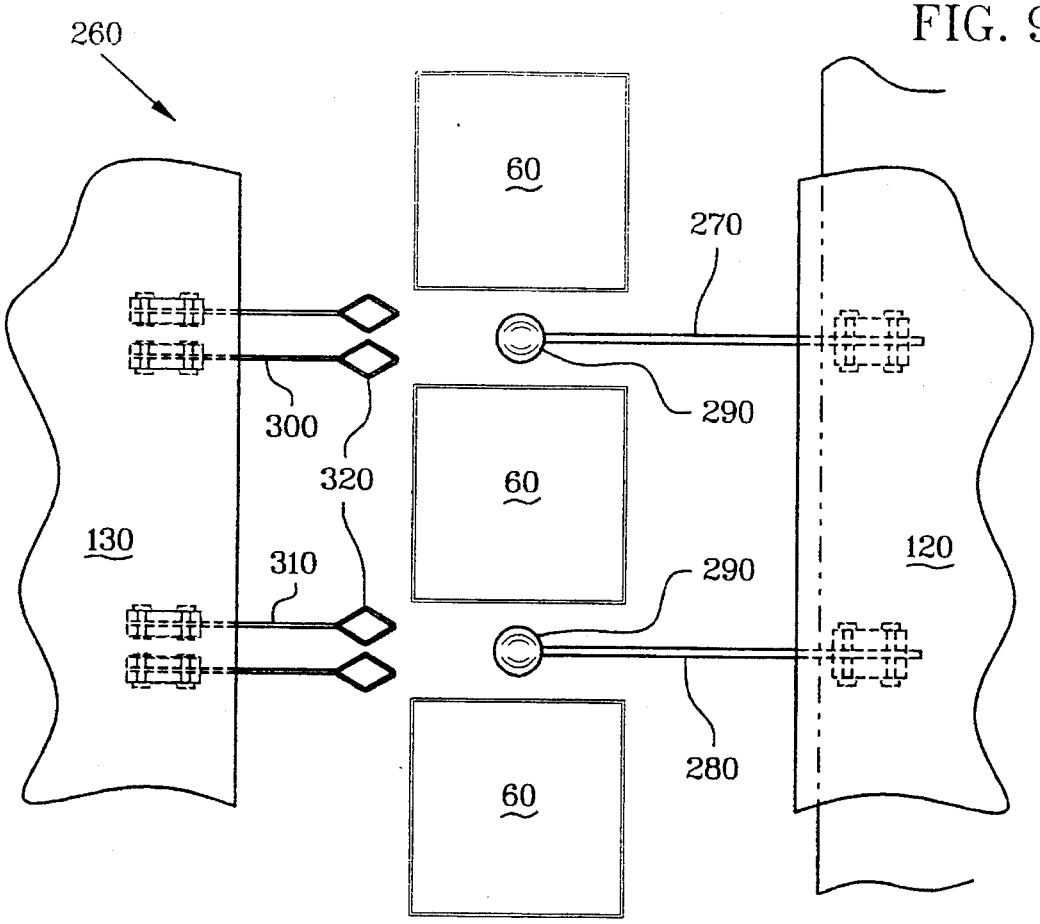
FIG. 9 is a top view of a further embodiment of the apparatus that employs the engagement between rods and spring members to exert a closing force on the opposed flaps of the carton as the sealing jaws move to form the seal.
Figure 10:
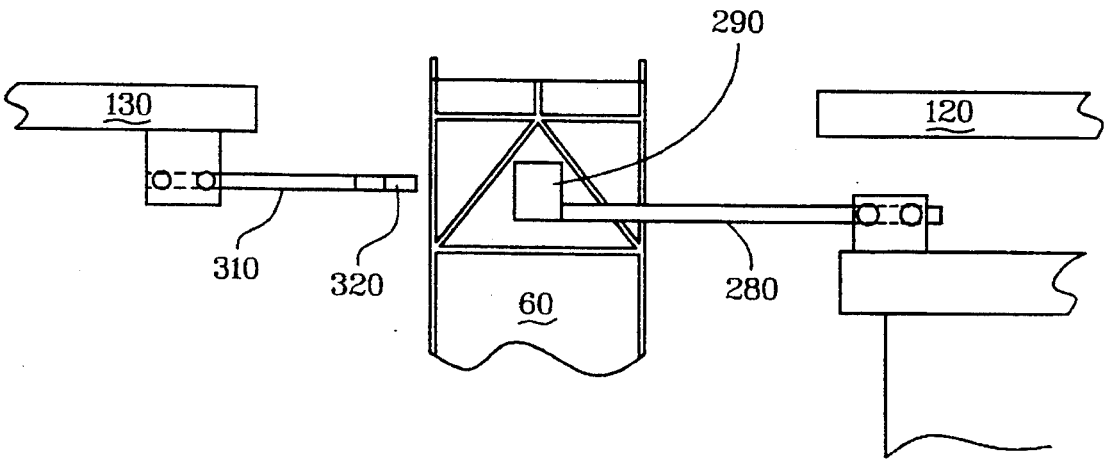
FIG. 10 is a side view of the apparatus of FIG. 9.
Figure 11:
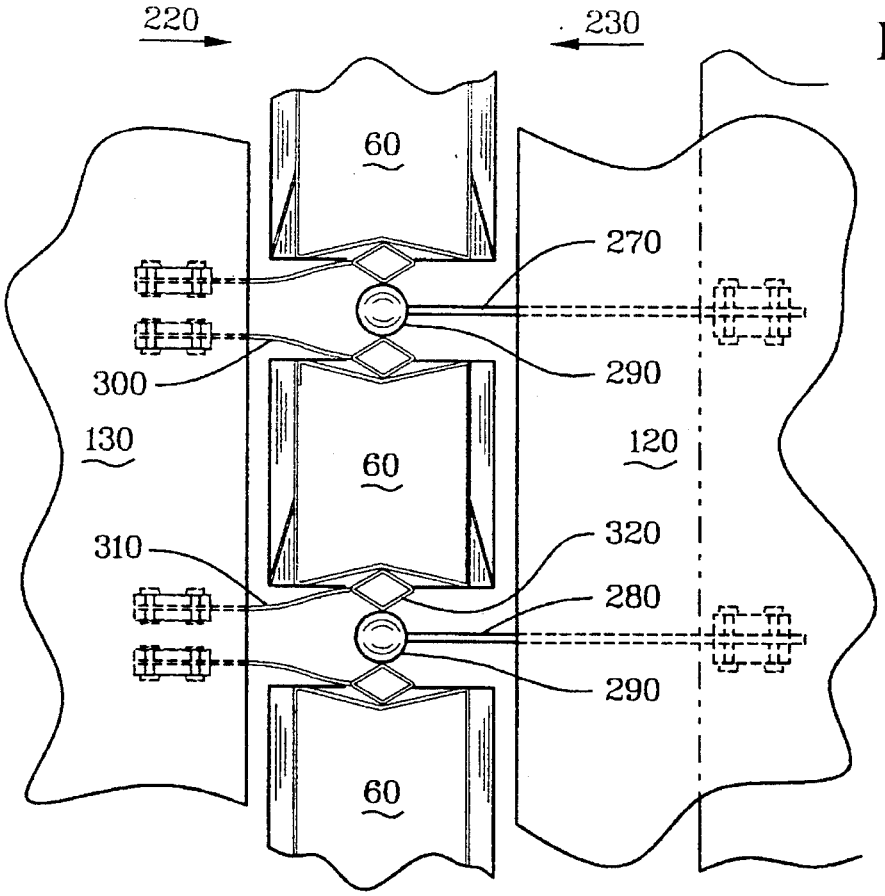
FIG. 11 is a top view of the apparatus of FIG. 9 illustrating movement of the sealing jaws to form and seal the fin.

FIG. 9 illustrates the apparatus 260 with the sealing jaws 120 and 130 in the first position. In this position, each rod 270 and 280 is disengaged from the respective spring member 140 and 150. As the sealing jaws 120 and 130 are moved to the second position, the rounded portions 290 of the rods 270 and 280 engage the shaped portions 320 of the respective spring members 300 and 310 in the manner illustrated in FIG. 11. This engagement causes deflection of the spring members 300 and 310 toward opposed flaps of the carton 60 thereby ensuring proper fin formation.

Figure 12:
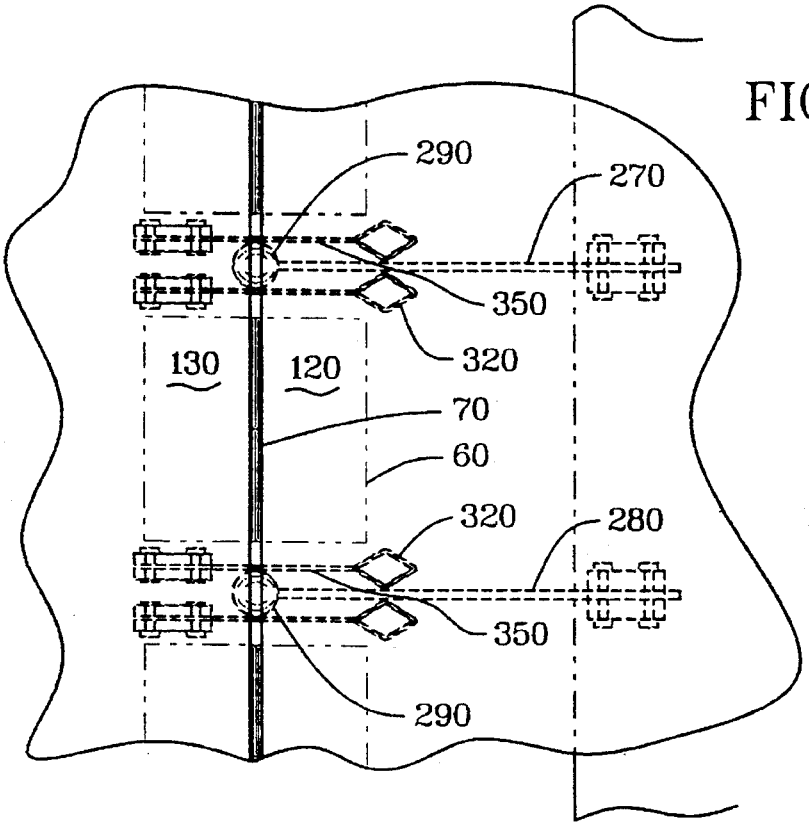
FIG. 12 is a top view of the apparatus of FIG. 9 illustrating the sealing jaws in a closed position about the fin.

FIG. 12 illustrates the apparatus 260 with the sealing jaws 120 and 130 in the second position in which the jaws seal the fin 70. In this position, the spring members 300 and 310 have returned to a non-deflected state. In the illustrated embodiment, each shaped portion 320 is engaged with a respective linear portion 350 of the rods 270 and 280 so as not to interfere with further sealing of the fin. After sealing, the sealing jaws 120 and 130 are returned to the first position and the carton 60 is removed from the sealing area between the jaws.

Other alternative configurations of the basic structure illustrated in FIGS. 9–12 may be utilized. In one such configuration, the spring members 300 and 310 may be in fixed engagement with respect to the sealing jaws 120 and 130 while the 270 and 280 may be attached to the sealing jaws 120 and 1 or 13. The relative orientation of the rods 270 and 280 and spring members 300 and 310 may also be modified to form different configurations of the illustrated structure. Further, it will be recognized that the rods 270 and 280 may be replaced by other shaped members which effect deflection of spring members 300 and 310.

Figure 13:
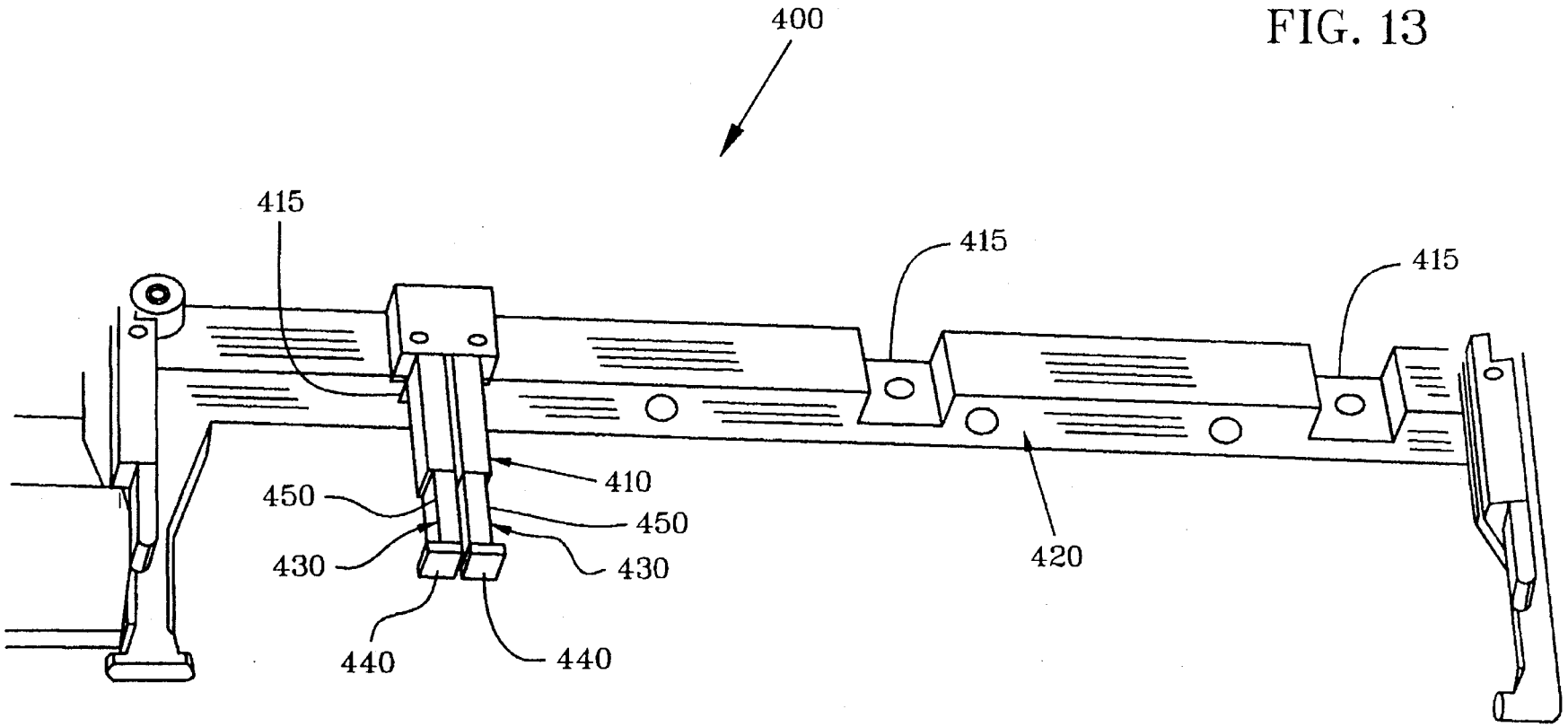
FIG. 13 is a perspective view of one embodiment of a rod assembly.

FIG. 13 is a perspective view of a rod assembly, shown generally at 400. The rod assembly 400 includes a plurality of dual rod members 410 each disposed in a respective notch 415 of a support frame 420. The support frame is secured, for example, in a fixed position below sealing jaw 120. The rods 430 each include a rectangular end portion 440 that initially engages its respective spring member as the jaws move from the first to the second position. After being deflected, the spring members engage the linear portion's 450 of the rods 430.

FIG. 13 also illustrates another embodiment that applies to a transverse force to opposed sides of the container. The illustrated embodiment includes a lever arm 500 connected for pivotal movement about a pivot shaft 510. A first end of arm 500 abuts a resilient robber cylinder 520. A second end of the arm 500 includes a contact nub 530 that, upon closing of the sealing jaws, contacts a pin (not shown) that is attached for co-movement with one of the jaws. Such contact causes the first end of the arem to apply a transverse force in the direction of arrow 540. A corresponding, but oppositely configured, lever arm is disposed on the opposite side of cannon 550 to apply a transvers force in the direction of arrow 560.

The illustrated embodiments have shown the apparatus as applied to the sealing of a top fin of a gabled container. The apparatus, however, can also be used with carton blanks, such as one or more of the cannon blanks set forth in U.S. Ser. No. 08/238,923 filed May 6, 1994. In such instances, the apparatus may be used to form and seal the presently disclosed bottom fin of the container as well.

Although the present invention has been described with reference to a specific embodiment, those of skill in the art will recognize that changes may be made thereto without departing from the scope and spirit of the invention as set forth in the appended claims.

We claim as our invention:

1. An apparatus for sealing a fin at a gabled end of a carton, the apparatus comprising:

longitudinal force means for applying a sealing force to a first pair of opposed flaps of the gabled end of the carton, the longitudinal force means being movable from a first position in which the gabled end of the carton is in a generally open condition to a second position at which the fin is sealed; and transverse force means for applying oppositely directed transverse forces to a second pair of opposed flaps of the gabled end of the carton as the longitudinal force means moves from the first position to the second position thereby moving the second pair of opposed flaps toward one another concurrent with the movement of the longitudinal force means as the longitudinal force means moves from the first position to the second position.

2. An apparatus as claimed in claim 1 wherein the longitudinal force means comprises first and second opposed sealing jaws that are movable toward one another to the second position and away from one another to the first position.

3. An apparatus as claimed in claim 2 wherein the first and second opposed sealing jaws seal the fin by applying pressure to the fin.

4. An apparatus as claimed in claim 2 wherein the first and second opposed sealing jaws seal the fin by applying ultrasonic energy and pressure to the fin.

5. An apparatus as claimed in claim 2 wherein the first and second opposed sealing jaws seal the fin by applying thermal energy and pressure to the fin.

6. An apparatus as claimed in claim 2 wherein the transverse force means comprises a pair of oppositely biased members disposed between the first and second opposed sealing jaws, the oppositely biased members contacting the second pair of opposed flaps of the gabled end of the carton as the first and second opposed sealing jaws move from the first position to the second position.

7. An apparatus as claimed in claim 6 wherein the oppositely biased members comprise:

a first formed spring extending between the first and second opposed sealing jaws, the first formed spring having a tensioned state in which the first formed spring is generally linear in shape and a relaxed state in which the first formed spring includes a curve, the first formed spring being in the tensioned state when the first and second jaws are in the first position and going to the relaxed state as the first and second jaws move toward one another from the first position to the second position; and a second formed spring extending between the first and second opposed sealing jaws, the second formed spring having a tensioned state in which the second formed spring is generally linear in shape and a relaxed state in which the second formed spring includes a curve, the curve of the first formed spring and the curve of the second formed spring being directed toward one another, the second formed spring being in the tensioned state when the first and second jaws are in the first position and going to the relaxed state as the first and second opposed sealing jaws move toward one another from the first position to the second position, each of the curves of the first and second springs engaging a respective one of the second pair of opposed flaps.

8. An apparatus as claimed in claim 7 wherein each of the first and second formed springs are comprised of formed spring steel.

9. An apparatus as claimed in claim 7 wherein the first and second formed springs each comprise a stop member.

10. An apparatus as claimed in claim 9 wherein the first and second formed springs each have a respective first end in fixed engagement with one of the first and second opposed sealing jaws and a respective second end slidably disposed through a respective aperture in one of the first and second opposed sealing jaws opposite the fixed engagement, the stop members of the first and second formed springs preventing the first and second formed springs from disengaging from the respective apertures when the first and second formed springs are in their respective tensioned states.

11. An apparatus as claimed in claim 1 wherein the transverse force means comprises:

a first formed spring connected to the longitudinal force means, the first formed spring having a tensioned state in which the first formed spring is generally linear in shape and a relaxed state in which the first formed spring includes a curve, the first formed spring being in the tensioned state when the longitudinal force means is in the first position, the first formed spring going to the relaxed state as the longitudinal means moves from the first position to the second position; and a second formed spring connected to the longitudinal force means, the second formed spring having a tensioned state in which the second formed spring is generally linear in shape and a relaxed state in which the second formed spring includes a curve, the curve of the first formed spring and the curve of the second formed spring being directed toward one another, the second formed spring being in the tensioned state when the longitudinal force means is in the first position, the second formed spring going to the relaxed state as the longitudinal force means moves from the first position to the second position.

12. An apparatus as claimed in claim 11 wherein each of the first and second formed springs are comprised of formed spring steel.

13. An apparatus as claimed in claim 12 wherein the transverse force means comprises:

a first deflecting member extending to a fixed position between the first and second opposed jaws, the first rod having a guide surface;

a second deflecting member extending to a fixed position between the first and second opposed jaws, the second rod having a guide surface;

a first spring member extending from one of the first and second opposed jaws, the first spring member having a guide surface that engages the guide surface of the first deflecting member as the first and second opposed sealing jaws move from the first position to the second position, engagement between the guide surface of the first deflecting member and the guide surface of the first spring member causing deflection of the first spring member to urge the first spring member toward one of the flaps of the second pair of opposed flaps: and a second spring member extending from one of the first and second opposed jaws, the second spring member having a guide surface that engages the guide surface of the second deflecting member as the first and second jaws move from the first position to the second position, engagement between the guide surface of the second deflecting member and the guide surface of the second spring member causing deflection of the second spring member to urge the second spring member toward the other flaps of the second pair of opposed flaps.

14. An apparatus as claimed in claim 13 wherein the first and second deflecting members are rods, each road having a generally curved surface that engages the guide surface of the respective first and second spring members.

15. An apparatus as claimed in claim 13 wherein the first and second spring members are each comprised of spring steel.

16. An apparatus for sealing a fin at a gabled end of a carton, the apparatus comprising:

a pair of opposed sealing jaws for applying a sealing force to form and seal the fin; and a pair of oppositely biased members disposed between the sealing jaws, the oppositely biased members contacting opposed flaps of the carton as the pair of opposed sealing jaws move to form and seal the fin thereby to assist in folding the opposed flaps toward one another.

17. An apparatus as claimed in claim 16 wherein the pair of opposed sealing jaws seal the fin by applying ultrasonic energy and the sealing force to the fin.

18. An apparatus as claimed in claim 16 wherein the pair of opposed sealing jaws seal the fin by applying thermal energy and the sealing force to the fin.

19. An apparatus as claimed in claim 16 wherein the pair of oppositely biased members comprise:

a first formed spring extending between the pair of opposed sealing jaws, the first formed spring having a tensioned state in which the first formed spring is generally linear in shape and a relaxed state in which the first formed spring includes a curve, the first formed spring going from the tensioned state to the relaxed state as the pair of opposed jaws move to apply the sealing force to the fin; and a second formed spring extending between the pair of opposed sealing jaws, the second formed spring having a tensioned state in which the second formed spring is generally linear in shape and a relaxed state in which the second formed spring includes a curve, the curve of the first formed spring and the curve of the second formed spring being directed toward one another, the second formed spring going from the tensioned state to the relaxed state as the opposed sealing jaws move to apply the sealing force to the fin, each of the curves of the first and second formed springs engaging a respective one of the second pair of opposed flaps.

20. An apparatus as claimed in claim 19 wherein each of the first and second formed springs are comprised of formed spring steel.

21. An apparatus as claimed in claim 19 wherein the first and second formed springs each include a stop member, the first and second formed springs each having a respective first end in fixed engagement with one of the jaws of the pair of opposed sealing jaws and a respective second end slidably disposed through a respective aperture in one of the jaws of the pair of opposed sealing jaws opposite the fixed engagement, the stop members of the first and second formed springs preventing the first and second formed springs from disengaging from the respective apertures when the first and second formed springs are in their respective tensioned states.

22. An apparatus for sealing a fin at a gabled end of a carton, the apparatus comprising:

a pair of opposed sealing jaws for applying a sealing force to form and seal the fin, the sealing jaws being movable from a first position in which the gabled end of the carton is in a generally open condition to a second position at which the fin is sealed;

a first elastic member disposed between the pair of opposed sealing jaws, the first elastic member having a first shape when the sealing jaws are in the first position, and assuming a second shape as the sealing jaws are moved to the second position; and a second elastic member disposed between the pair of opposed sealing jaws and spaced from the first elastic member, the second elastic member having a first shape when the sealing jaws are in the first position, and assuming a second shape as the sealing jaws are moved to the second position, the first and second elastic members applying oppositely directed forces to opposed flaps of the carton as each of the first and second elastic members goes from its respective first shape to its respective second shape.

23. An apparatus as claimed in claim 22 wherein the pair of opposed sealing jaws seal the fin by applying ultrasonic energy and the sealing force to the fin.

24. An apparatus as claimed in claim 22 wherein the pair of opposed sealing jaws seal the fin by applying thermal energy and the sealing force to the fin.

25. An apparatus as claimed in claim 22 wherein the first and second elastic members each comprise:

a formed spring extending between the pair of opposed sealing jaws, the first shape of the formed spring being generally linear in shape and the second shape of the formed spring including a curve, the formed spring being in the first shape when the opposed first and second jaws are in the first position and going to the relaxed state as the pair of opposed sealing jaws move toward one another from the first position to the second position.

26. An apparatus as claimed in claim 25 wherein the curve of the formed spring that forms the first elastic member and the curve of the formed spring that forms the second elastic member are directed toward one another.

27. An apparatus as claimed in claim 25 wherein the formed spring is comprised of formed spring steel.

28. An apparatus for sealing a fin at a gabled end of a carton, the apparatus comprising:

a first sealing jaw having first and second apertures disposed therethrough;

a second sealing jaw, the first and second jaws being movable with respect to one another from a first position in which the gabled end of the carton is in an open condition to a second position at which the first and second sealing jaws engage and seal the fin;

a first elastic member having a stop member at one end thereof and having another end thereof in fixed engagement with the second sealing jaw, the one end of the first elastic member being disposed for sliding through the first aperture of the first sealing jaw, the stop member preventing the first elastic member from disengaging from the first aperture when the first and second sealing jaws are in the first position, the first elastic member having a first shape when the first and second sealing jaws are in the first position, and assuming a second relaxed shape as the first and second sealing jaws are moved to the second position; and a second elastic member having a stop member at one end thereof and having another end thereof in fixed engagement with the second sealing jaw, the one end of the second elastic member being disposed for sliding through the second aperture of the first sealing jaw, the stop member preventing the second elastic member from disengaging from the second aperture when the first and second sealing jaws are in the first position, the second elastic member having a first shape when the first and second sealing jaws are in the first position, and assuming a second shape as the first and second sealing jaws are moved to the second position, the first and second elastic members applying oppositely directed forces to opposed flaps of the gabled end of the carton as the first and second elastic members go from their respective first shapes to their respective second shapes.

29. An apparatus as claimed in claim 28 wherein the first and second elastic members are each comprised of formed spring steel.

30. An apparatus as claimed in claim 28 wherein the first and second sealing jaws seal the fin by applying pressure to the fin.

31. An apparatus as claimed in claim 28 wherein the first and second sealing jaws seal the fin by applying ultrasonic energy and pressure to the fin.

32. An apparatus as claimed in claim 28 wherein the first and second sealing jaws seal the fin by applying thermal energy and pressure to the fin.

33. An apparatus as claimed in claim 28 wherein the first shape of the first and second elastic members is a generally linear shape.

34. An apparatus as claimed in claim 33 wherein the second shape of the first and second elastic members includes a curved shape.

35. An apparatus as claimed in claim 34 wherein the curves of the first and second elastic members are directed toward one another when the first and second members are in their second shape.

36. An apparatus for sealing a fin at a gabled end of a carton, the apparatus comprising:

a pair of opposed sealing jaws for applying a sealing force to a first pair of opposed flaps of the gabled end of the carton to form and seal the fin;

a pair of deflecting members disposed between the opposed sealing jaws;

a pair of spring members disposed between the pair of opposed sealing jaws, the pair of spring members engaging the pair of deflecting members as the opposed sealing jaws move to form and seal the fin, engagement of the spring members and deflecting members causing the pair of spring members to contact a second pair of opposed flaps of the gabled end of the carton thereby to assist in folding the opposed flaps toward one another.

37. An apparatus as claimed in claim 36 wherein the pair of opposed sealing jaws seal the fin by applying ultrasonic energy and the sealing force to the fin.

38. An apparatus as claimed in claim 36 wherein the pair of opposed sealing jaws seal the fin by applying thermal energy and the sealing force to the fin.

39. An apparatus as claimed in claim 36 wherein each of the first and second spring members are comprised of spring steel.

40. An apparatus as claimed in claim 36 wherein each of the deflecting members is in a fixed position between the pair of opposed sealing jaws and wherein the pair of spring members are connected for movement with the pair of opposed sealing jaws.

41. An apparatus as claimed in claim 36 wherein each of the spring members is in a fixed position between the pair of opposed sealing jaws and wherein the pair of deflecting members are connected for movement with the pair of opposed sealing jaws.

42. An apparatus for sealing a fin at a gabled end of a carton, the apparatus comprising:

a first sealing jaw;

a second sealing jaw disposed opposite the first sealing jaw, the first and second sealing jaws being movable from a first position in which the gabled end of the carton is in an open condition to a second position at which the fin is sealed;

a first deflecting member extending between the first and second sealing jaws, the first deflecting member having a guide surface;

a second deflecting member extending between the first and second sealing jaws, the second deflecting member having a guide surface;

a first spring member connected for movement with one of the first and second sealing jaws, the first spring member having a guide surface at an end thereof that engages the guide surface of the first deflecting member as the first and second sealing jaws move from the first position to the second position, engagement between the guide surface of the first deflecting member and the guide surface of the first spring member causing deflection of the first spring member in a direction that is transverse to the direction of movement of the first and second sealing jaws; and a second spring member connected for movement with one of the first and second sealing jaws, the second spring member having a guide surface disposed at an end thereof that engages the guide surface of the second deflecting member as the first and second jaws move from the first position to the second position, engagement between the guide surface of the second deflecting member and the guide surface of the second spring member causing deflection of the second spring member to urge the second spring member in a direction that is transverse to the direction of movement of the first and second sealing jaws and opposite to the direction of deflection of the first spring member.

43. An apparatus as claimed in claim 42 wherein the first and second sealing jaws seal the fin by applying ultrasonic energy and the pressure to the fin.

44. An apparatus as claimed in claim 42 wherein the first and second sealing jaws seal the fin by applying thermal energy and the pressure to the fin.

45. An apparatus as claimed in claim 42 wherein each of the first and second spring members are comprised of spring steel.

46. An apparatus as claimed in claim 42 wherein the guide surface of the first spring member comprises an angled section at the end of the first spring member.

47. An apparatus as claimed in claim 42 wherein the guide surface of the second spring member comprises an angled section at the end of the second spring member.

48. An apparatus as claimed in claim 42 wherein the guide surfaces of the first spring member and the first deflecting member are shaped with respect to one another so as to cause the first spring member to resume its non-deflected shape as the first and second sealing jaws approach the second position.

49. An apparatus as claimed in claim 48 wherein the guide surfaces of the second spring member and the second deflecting member are shaped with respect to one another so as to cause the spring member to resume its non-deflected shape as the first and second sealing jaws approach the second position.

* * * * *

UNITED STATES PATENT AND TRADEMARK OFFICE

CERTIFICATE OF CORRECTION

PATENT NO. : 5,518,578

ISSUED : May 21, 1996

INVENTOR(S) : Persells et al.

It is certified that errors appear in the above-identified patent and that said Letters Patent is hereby corrected as shown below:

Please change "4,769,171" to 4,759,171 in the "References Cited" section.

In line 50, delete "robber" and insert - - rubber - - therefor.

In line 54, delete "arem" and insert - - arm - - therefor.

In line 57, delete "cannon" and insert - - carton - - therefor.

In line 63, delete "cannon" and insert - - carton - - therefor.

Signed and Sealed this

Twenty-seventh Day of August, 1996

*Attest:*

Bruce Lehman

BRUCE LEHMAN

*Attesting Officer*

*Commissioner of Patents and Trademarks*